US006269744B1

(12) United States Patent
Blaser et al.

(10) Patent No.: US 6,269,744 B1
(45) Date of Patent: Aug. 7, 2001

(54) DEVICE FOR CHANGING INK CARTRIDGES IN AN OFFSET PRINTING PRESS

(75) Inventors: Peter Theobald Blaser, Dielheim; Renko Möllers, Sendenhorst, both of (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/283,071

(22) Filed: Mar. 31, 1999

(30) Foreign Application Priority Data

Mar. 31, 1998 (DE) ..... 198 14 342

(51) Int. Cl.[7] ..... B41F 31/02
(52) U.S. Cl. ..... 101/494; 101/364; 101/350.1
(58) Field of Search ..... 221/210, 102; 101/350.1, 364, 365, 366, 484, 351.2, 351.4, 352.02, 494; 414/416, 811; 346/139 R

(56) References Cited

U.S. PATENT DOCUMENTS 4,885,701 * 12/1989 Gunderson et al. ..... 346/139 R
4,920,357 * 4/1990 Johnson ..... 346/139 R
5,724,890 * 3/1998 Deschner et al. ..... 101/366

FOREIGN PATENT DOCUMENTS 94 20 159 5/1995 (DE) .
195 12 727 A1 10/1996 (DE) .
195 15 621 A1 10/1996 (DE) .

* cited by examiner

*Primary Examiner*—John S. Hilten
*Assistant Examiner*—Leslie J. Grohusky
(74) *Attorney, Agent, or Firm*—Herbert L. Lerner; Laurence A. Greenberg; Werner H. Stemer

(57) ABSTRACT

A device for filling with printing ink a respective ink duct of various printing units of a printing press, provided with an ink cartridge reciprocatingly movable on a crossbar above the respective ink duct, includes a container system provided with a plurality of ink cartridges, the container system being mounted so as to be movable along the printing press, a control unit for controlling the container system, and a gripper system disposed in the container system for changing the ink cartridges.

8 Claims, 3 Drawing Sheets

PRINTING CONTROL STATION
1
2
3
4
5
6
7
8
9
14

DEVICE FOR CHANGING INK CARTRIDGES IN AN OFFSET PRINTING PRESS

BACKGROUND OF THE INVENTION

1. Field of the Invention

The invention relates to a device for changing ink cartridges for filling an ink duct in an offset printing press.

The filling of an ink duct with printing ink from an ink cartridge has become known heretofore, for example, from the published German Patent Document DE 195 12 727 A1. Such ink cartridges are inserted manually by the pressman into a holder system and are then replaced when they become empty.

2. Summary of the Invention

It is accordingly an object of the invention to provide a device for changing ink cartridges of the general type described in the aforementioned published German patent document in an offset printing press, wherein the changing of the ink cartridges is performed automatically.

With the foregoing and other objects in view, there is provided, in accordance with the invention, a device for filling with printing ink a respective ink duct of various printing units of a printing press, including an ink cartridge reciprocatingly movable on a crossbar above the respective ink duct, comprising a container system provided with a plurality of ink cartridges, the container system being mounted so as to be movable along the printing press, a control unit for controlling the container system, and a gripper system disposed in the container system for changing the ink cartridges.

In accordance with another feature of the invention, the container system is enlargeable.

In accordance with a further feature of the invention, the container system is exchangeably arranged for loading the printing press.

In accordance with an added feature of he invention, the container system includes both full and empty ink cartridges.

In accordance with an additional feature of the invention, the device includes a sensor provided for detecting an optical identification feature on a respective ink cartridge.

In accordance with yet another feature of the invention, the sensor is an ink detecting sensor provided for detecting printing ink in the respective ink cartridge.

In accordance with yet a further feature of the invention, the control unit is connectable to a printing control station.

In accordance with a concomitant feature of the invention, the container system is embodied as a revolving magazine.

An advantage derived from the invention is that a removal of emptied cartridges and an insertion of full cartridges from an ink supply system is performable fully automatically, without requiring operating personnel to aid in the process. By a monitoring device provided on the cartridge for monitoring the fill level of the cartridge, a printing control station, for example, is informed that an ink cartridge has been emptied, and an operation replacing the empty ink cartridge with a full ink cartridge is accordingly tripped or released. A container system that is movable along all of the printing units then positions itself at the respective printing unit where a cartridge change is required. This container system is supported on rail guides, for example, and is disposed so that it can move along the long side of the printing press.

A feature of the invention provides for an optimization of logistics, by so disposing the container system so that it is completely exchangeable. This offers the advantage that the equipping of the container system can be performed, for example, manually outside the printing press, without causing additional down time for the printing press. The container system equipped with full ink cartridges is then simply exchanged for a container system that has empty, or partly empty, ink cartridges.

The container system can advantageously be embodied so that it is enlargeable or expandable. A standard container for five ink cartridges, for example, can be constructed so that further standard containers can be lined up with one another thereabove or therebelow. At the same time, a control unit receives a signal indicating the number of standard containers lined up with one another, and assurance is thereby provided that ink cartridges will be delivered to the ink supply system from all the standard containers lined up with one another.

An advantageous feature provides for the changing device to have a sensor assigned thereto, that prevents the mistake of one printing ink or for another. To that end, the ink cartridge has an optical identification feature, for example. It is also conceivable for the sensor to have the capability of recognizing color, so that if the ink cartridges are kept transparent, it is easy to identify the color in the ink cartridge. This sensor could be told, for example, by the printing control station, which printing ink is currently being used for printing in which printing unit. This offers the advantage that the ink cartridges can be placed in random order in the container system. By connecting the container system to the printing control station, an advantage is also derived from the fact that an ink consumption report for a printing job, an overview of the ink cartridges on hand, and so forth can be made simultaneously.

Another feature provides for a device mounted on the movable container system for taking the empty ink cartridge from the printing unit and replacing it with a full ink cartridge from the container system. This could, for example, be effected by a gripper system that grasps the ink cartridge by an upper edge thereof, takes it from the metering device in the inking unit, and places it at a location reserved therefor in the container system. In a return motion, the gripper system picks up a full ink cartridge and places it in the metering device. It is also conceivable, however, for the movable container system to be driven directly to the inking unit and to perform the cartridge-changing operation thereat without any additional device being involved. To that end, by way of example, the container system could be a rotatably supported plate similar to a revolving magazine. Such devices are known, for example, in multicolor plotters, and may be positioned above the ink cartridge that is to be changed and, by compressed air, may push the emptied, and thus lightweight, ink cartridge into an idle position, while the full ink cartridge, after positioning, automatically drops by gravity into the holder for the metering system.

It could be advantageous for empty and full cartridges to be placed, for example, on two different levels in the container system. The pressman inter can thus readily see which cartridges remain full and which cartridges ones are already empty, respectively.

Other features which are considered as characteristic for the invention are set forth in the appended claims.

Although the invention is illustrated and described herein as embodied in a device for changing ink cartridges in an offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
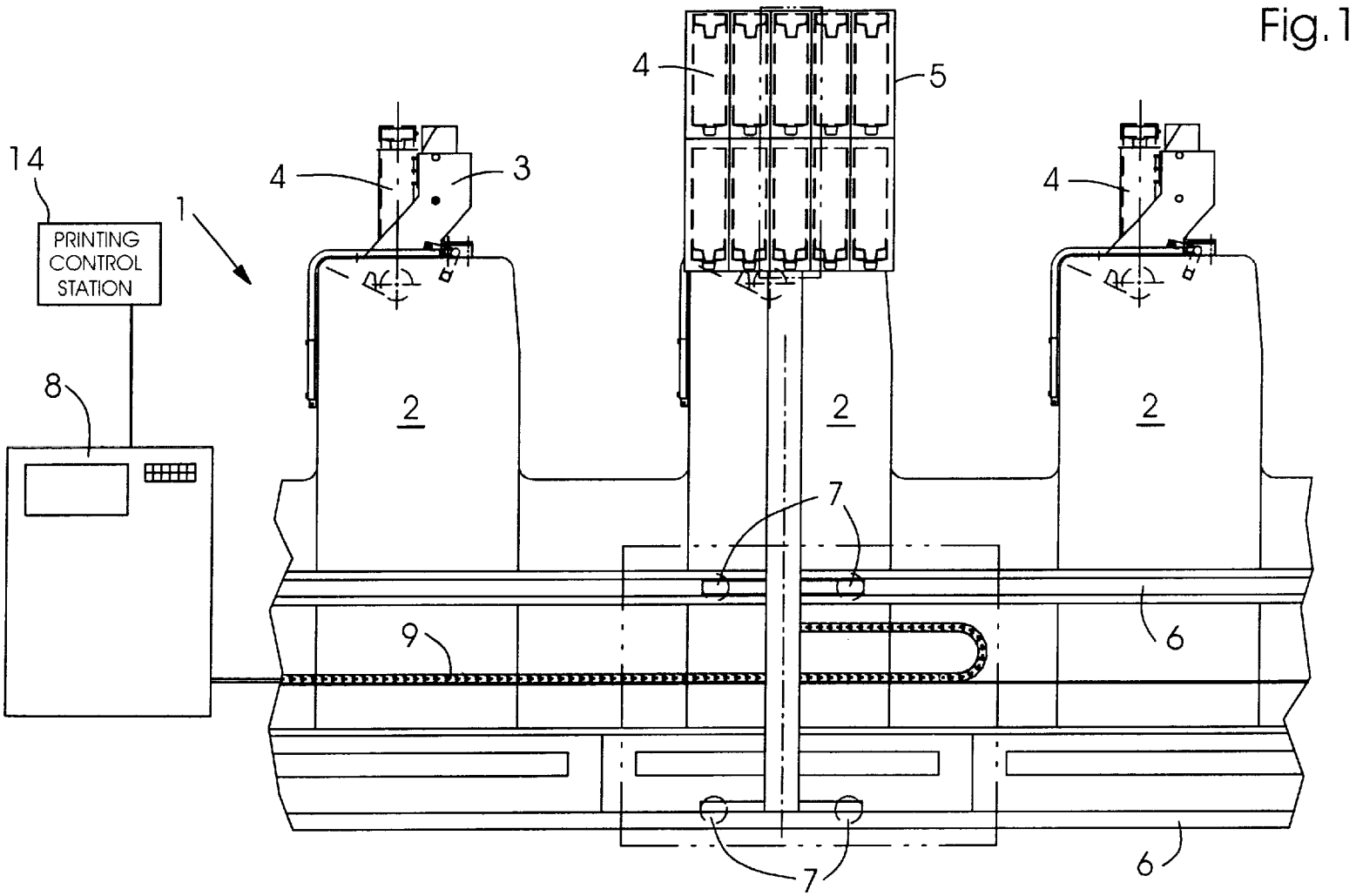
FIG. 1 is a side elevational view of a printing press with a container system forming part of the invention.

Referring now to the drawings and, first, particularly to FIG. 1 thereof, there is shown therein a printing press 1, for example, a sheet-fed printing press, with a plurality of successively arranged printing units 2. A crossbar with a metering device 3 is disposed on the printing units, and an ink cartridge 4 for metering printing ink is movably disposed thereby above a non-illustrated ink duct. A container system 5 is located on the middle one of the printing units 2 shown, and a plurality of ink cartridges 4 are arranged therein. The container system 5 is disposed so as to be movable by rollers 7 on a rail system 6, that extends along the long side of the printing press 1. A control unit 8, connectable to a printing control station 14, assumes and performs the task of positioning the container system 5 at the various printing units 2 and, as needed, provides for the exchange or replacement of the ink cartridges 4. The container system 5 is connected to the control unit 8 by a suitable line system 9.

Figure 2:
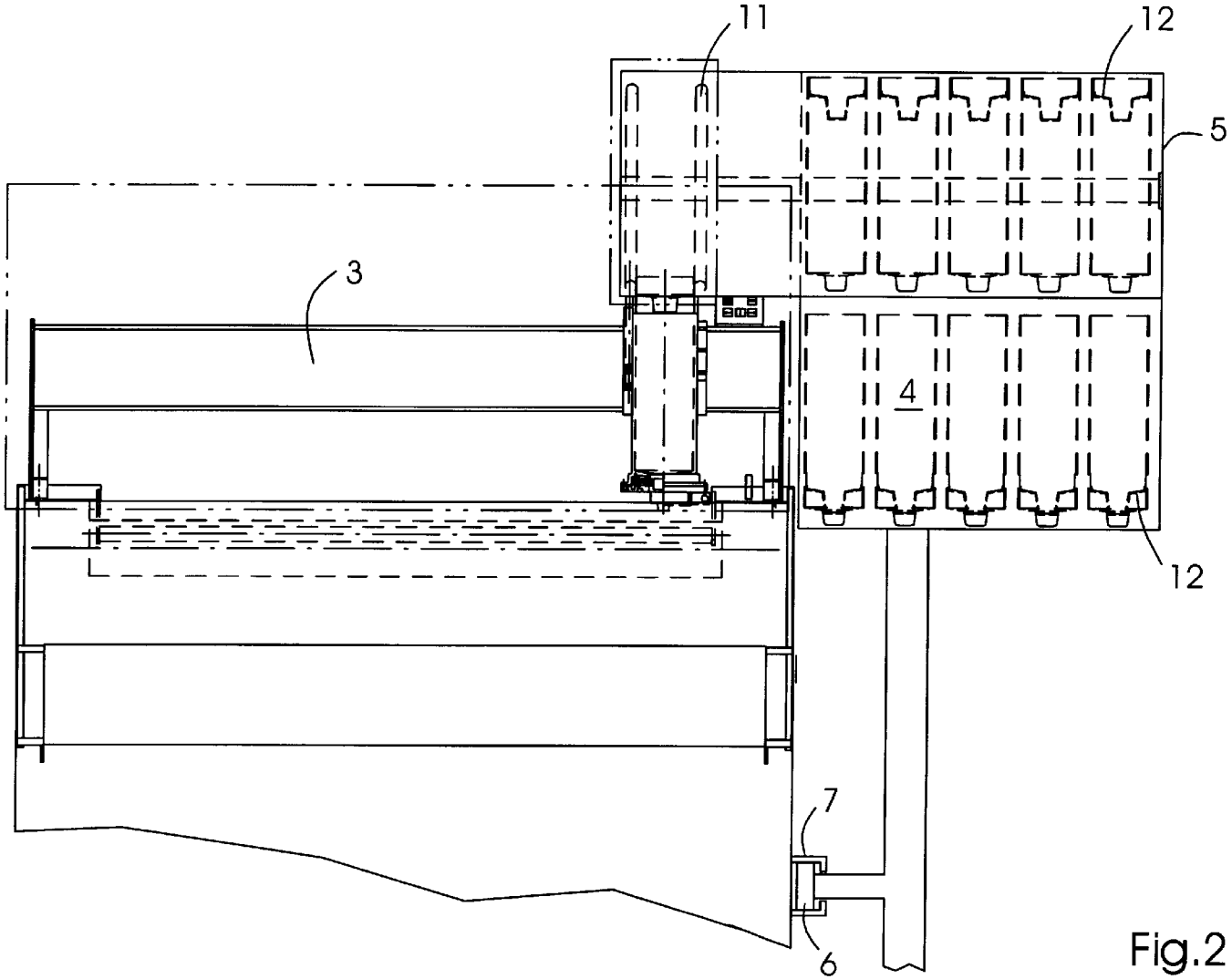
FIG. 2 is an enlarged front elevational view of a printing unit of the printing press with the container system.

FIG. 2 is a front elevational view of the container system 5 and of the printing units 2. The container system 5 is positioned so that a changing operation for a cartridge 4 can be performed. To that end, the cartridge 4 located on the crossbar with the metering device 3, has been moved into a position that makes a changing operation possible. A movable gripper system 11 is mounted on a crossbar 10 (see FIG. 3), and ink cartridges 4 from the container system 5 are movable by the gripper system 11 into a container-changing position. In this regard, the gripper system 11 can grasp a cartridge 4 by the upper edge thereof, for example, and transport it in that manner. Filled cartridges 4 are located in the upper part of the container system 5, whereas emptied cartridges 4 are located in the lower part thereof. This is readily apparent from the fact that a piston 12 for the upper cartridges 4 is in an upper position, whereas, for the emptied cartridges in the lower part of the container system 5, the piston 12 is in a lower position.

Figure 3:
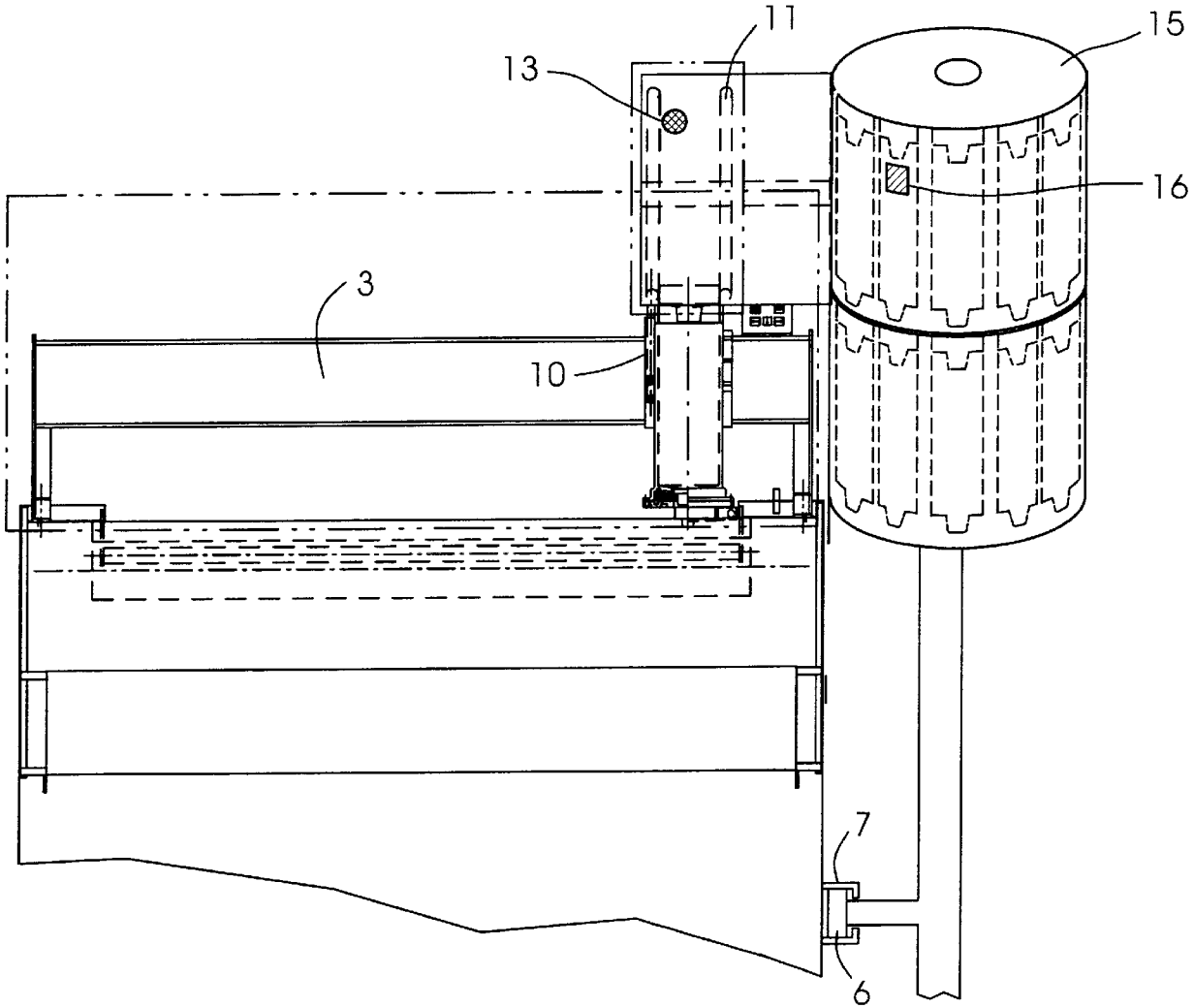
FIG. 3 is an enlarged front elevational view of a printing unit of the printing press with an alternative embodiment of the container system.

FIG 3. is a front elevational view of an alternative embodiment of the container system 5 and of the printing units 2. The container system 15 is a revolving container magazine. The changing device 11 is shown with a representation of a sensor 13 for identifying the ink cartridges through, for example, optical identification or color identification, and an optical marking 16 on the ink cartridge.

The gist or concept of the invention is obviously not to be limited to the embodiments discussed hereinabove, but rather, may be realized in the most varied constructions of storage or magazine technology.

We claim:

1. A device for filling with printing ink a respective ink a respective ink duct of various printing units of a printing press, the printing units including a crossbar disposed above the respective ink duct for reciprocatingly moving an ink cartridge, the device comprising:

a container system provided with a plurality of ink cartridges, said container system being mounted so as to be movable along the printing units of the printing press;

a control unit for controlling said container system; and a gripper system disposed at said container system for changing the ink cartridges of each of the printing units for filling the respective ink duct of the various printing units.

2. The device according to claim 1, wherein said container system is enlargeable.

3. The device according to claim 1, wherein said container system is exchangeably arranged for loading the printing press.

4. The device according to claim 1, wherein said container system includes both full and empty ink cartridges.

5. The device according to claim 1, including a sensor provided for detecting an optical identification feature on a respective ink cartridge, said sensor being associated with said gripper system.

6. The device according to claim 5, wherein said sensor is an ink detecting sensor provided for detecting printing ink in the respective ink cartridge.

7. The device according to claim 1, wherein said control unit is connectable to a printing control station.

8. The device according to claim 1, wherein said container system is embodied as a revolving magazine.

* * * * *

UNITED STATES PATENT AND TRADEMARK OFFICE

CERTIFICATE OF CORRECTION

PATENT NO. : 6,269,744 B1
DATED : August 7, 2001
INVENTOR(S) : Peter Theobald Blaser et al.

It is certified that error appears in the above-identified patent and that said Letters Patent is hereby corrected as shown below:

Column 4,
Lines 18-19 should read as follows:
-- 1. A device for filling with printing ink a respective ink duct of various printing units of a printing --.

Signed and Sealed this

Twenty-third Day of April, 2002

*Attest:*

*Attesting Officer*

JAMES E. ROGAN
*Director of the United States Patent and Trademark Office*